US008786657B2

(12) United States Patent
Aruga

(10) Patent No.: US 8,786,657 B2
(45) Date of Patent: Jul. 22, 2014

(54) IMAGE FORMING APPARATUS WITH STRUCTURE FOR SUPPRESSING POSITION VARIATION OF EXPOSURE UNIT CAUSED BY VIBRATIONS GENERATED THEREIN

(75) Inventor: Daisuke Aruga, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/545,550

(22) Filed: Jul. 10, 2012

(65) Prior Publication Data

US 2013/0027498 A1 Jan. 31, 2013

(30) Foreign Application Priority Data

Jul. 25, 2011 (JP) ..... 2011-161653

(51) Int. Cl.
*B41J 2/435* (2006.01)
*B41J 15/14* (2006.01)
*B41J 27/00* (2006.01)

(52) U.S. Cl.
USPC ..... 347/242; 347/257; 347/263

(58) Field of Classification Search
USPC ..... 347/241, 242, 245, 256, 257, 263
See application file for complete search history.

(56) References Cited

U.S. PATENT DOCUMENTS

| | | | | |
|---|---|---|---|---|
| 6,982,736 | B2 * | 1/2006 | Okugawa et al. | 347/152 |
| 7,136,088 | B2 * | 11/2006 | Yoshida et al. | 347/242 |
| 7,251,062 | B2 * | 7/2007 | Harris et al. | 358/497 |
| 7,342,600 | B2 * | 3/2008 | Nakano | 347/257 |

FOREIGN PATENT DOCUMENTS

| | | | | |
|---|---|---|---|---|
| JP | 2004-98441 A | | 4/2004 | |
| JP | 2007-25052 A | | 2/2007 | |
| JP | 2007025052 A | * | 2/2007 | G02B 26/12 |

* cited by examiner

*Primary Examiner* — Hai C Pham
(74) *Attorney, Agent, or Firm* — Fitzpatrick, Cella, Harper & Scinto

(57) ABSTRACT

An image forming apparatus, including: an image bearing member; a latent image forming unit configured to emit a light beam based on image data and to form an electrostatic latent image on the image bearing member by the light beam; a placement unit provided in a main body of the image forming apparatus, on which the latent image forming unit is placed; an elastic member disposed between the latent image forming unit and the placement unit; and a pressing unit provided in the main body of the image forming apparatus and configured to press the latent image forming unit toward the placement unit so that the elastic member is pressed by the latent image forming unit and the placement unit.

12 Claims, 7 Drawing Sheets

①: VIBRATION BETWEEN DRIVE SOURCE AND FRAME
②: VIBRATION BETWEEN FRAME AND STAY
③: VIBRATION OF STAY
④: VIBRATION BETWEEN STAY AND LIGHT SCANNING APPARATUS

IMAGE FORMING APPARATUS WITH STRUCTURE FOR SUPPRESSING POSITION VARIATION OF EXPOSURE UNIT CAUSED BY VIBRATIONS GENERATED THEREIN

BACKGROUND OF THE INVENTION

1. Field of the Invention

The present invention relates to vibration and positioning of a light scanning apparatus in an image forming apparatus.

2. Description of the Related Art

In general, each component such as a light scanning apparatus, a photosensitive drum, a developing device, or a fixing device in an image forming apparatus is mounted on a support member such as a stay, and is mounted, together with the support member, on two side plates provided in the image forming apparatus in a state of being mounted on the support member. In such a configuration, a vibration generated by motor driving or engagements of gears of the photosensitive drum, the developing device, or the fixing device is transmitted through the side plates and the stay, finally to the light scanning apparatus. As a result, the light scanning apparatus itself or an optical component provided in the light scanning apparatus is forcedly vibrated. If the frequency of the transmitted vibration is close to the natural frequency of the light scanning apparatus itself or the optical component provided in the light scanning apparatus, the light scanning apparatus itself or the optical component provided in the light scanning apparatus resonates. This leads to a change in a laser irradiation position of a laser light emitted from the light scanning apparatus to the photosensitive drum, causing a defective image. Therefore, it is desired to reduce the vibration transmitted to the light scanning apparatus.

As a countermeasure against the vibration, a scanning optical apparatus disclosed in Japanese Patent Application Laid-Open No. 2007-25052 reduces a vibration of the scanning optical apparatus generated when a rotational polygon mirror in the scanning optical apparatus rotates, by mounting the scanning optical apparatus on an image forming apparatus via a viscoelastic member. On the other hand, an image forming apparatus disclosed in Japanese Patent Application Laid-Open No. 2004-98441 employs a structure in which a laser scanner is mounted on a scanner supporting component via an anti-vibration member so that the laser scanner is coupled to the scanner supporting component together with the anti-vibration member by using an adjustment screw. This structure reduces a vibration that is transmitted from various drive sources in the image forming apparatus to the laser scanner.

However, the scanning optical apparatus disclosed in Japanese Patent Application Laid-Open No. 2007-25052 has a structure in which the scanning optical apparatus mounted on a frame mounting portion via the viscoelastic member is fixed by being pressed in a direction of gravity by a fixing spring. Therefore, the scanning optical apparatus is supported by the elastic members from above and from below, and hence the elastic member reduces the vibration transmitted to the scanning optical apparatus. However, positioning in the direction of gravity may not be achieved to a sufficient level. As a result, it may be difficult to guarantee a laser beam scanning position on a surface of a photosensitive drum.

In addition, in the image forming apparatus disclosed in Japanese Patent Application Laid-Open No. 2004-98441, although positioning in the direction of gravity can be achieved by adjusting a tightening amount of the adjustment screw, the laser scanner and the scanner supporting component are integrated by the adjustment screw and thus vibrate together, weakening the anti-vibration effect obtained by interposing the anti-vibration member between the laser scanner and the scanner supporting component. Further, although the anti-vibration member is interposed between the laser scanner and the scanner supporting component, there is a possibility that the adjustment screw becomes another path for transmitting the vibration, and the vibration is transmitted from the scanner supporting component to the laser scanner.

SUMMARY OF THE INVENTION

The present invention has been made in view of the above-mentioned circumstances, and it is an object of the present invention to reduce a vibration transmitted from a placement unit to a light scanning apparatus and to determine a position of the light scanning apparatus on the placement unit.

The present invention provides an image forming apparatus, including: an image bearing member; a latent image forming unit configured to emit a light beam based on image data and to form an electrostatic latent image on the image bearing member by the light beam; a placement unit provided in a main body of the image forming apparatus, on which the latent image forming unit is placed; an elastic member disposed between the latent image forming unit and the placement unit; and a pressing unit provided in the main body of the image forming apparatus and configured to press the latent image forming unit toward the placement unit so that the elastic member is pressed by the latent image forming unit and the placement unit.

According to the present invention, a vibration transmitted from the placement unit to the light scanning apparatus can be reduced and the position of the light scanning apparatus on the placement unit can be determined.

Further features of the present invention will become apparent from the following description of exemplary embodiments with reference to the attached drawings.

DESCRIPTION OF THE EMBODIMENTS

Exemplary embodiments of the present invention will be described in detail below.

First Embodiment

Outline of Image Forming Apparatus

Figure 1:
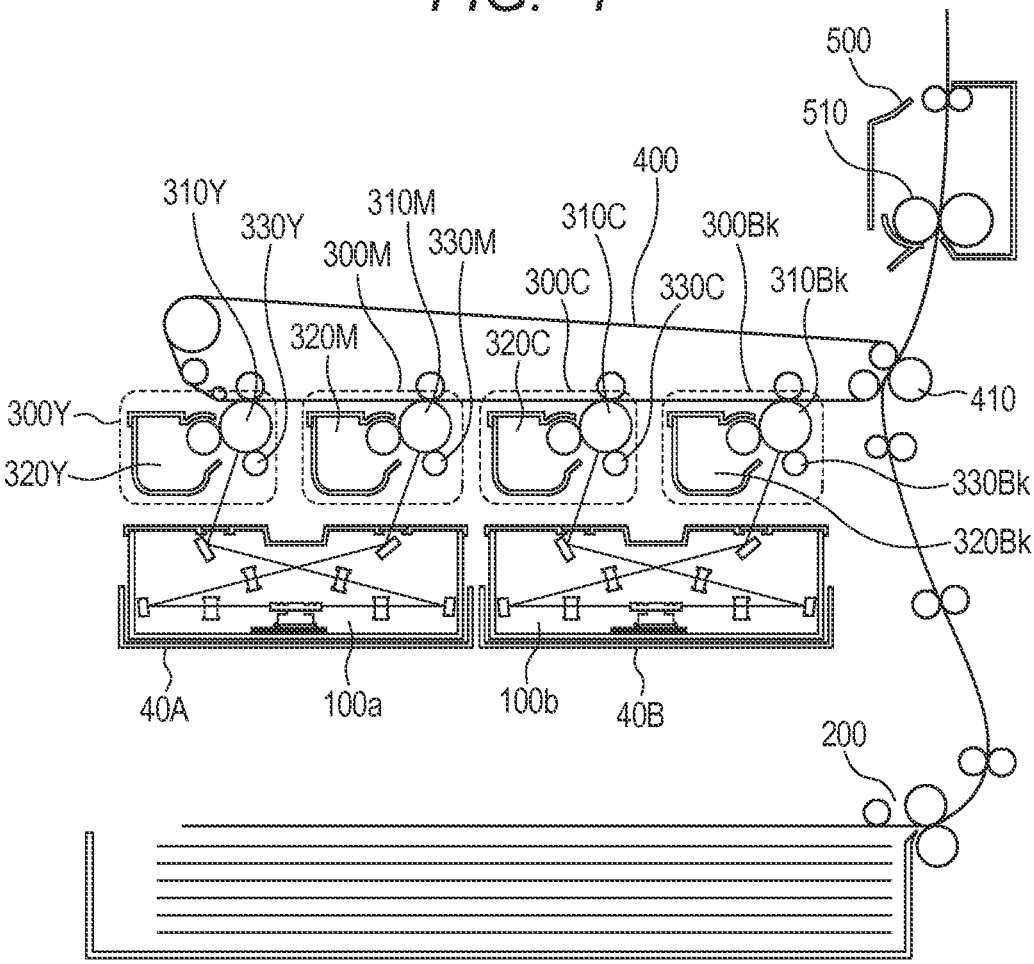
FIG. 1 is a diagram illustrating an image forming apparatus according to first and second embodiments.

FIG. 1 is a schematic diagram illustrating a configuration of an image forming apparatus according to a first embodiment. The image forming apparatus illustrated in FIG. 1 includes four image forming engines 300Y, 300M, 300C, and 300Bk configured to respectively form toner images of yellow, magenta, cyan, and black. Hereinafter, the symbols Y, M, C, and Bk are omitted except when a specific color is described. The image forming engine 300 includes a photosensitive drum 310, a charging roller 330, and a developing device 320. The charging roller 330 charges the photosensitive drum 310 to a uniform potential, and the developing device 320 develops an electrostatic latent image formed on the photosensitive drum (image bearing member) 310 by an exposure with laser light output from a light scanning apparatus (latent image forming unit) 100 into a toner image. The image forming engine 300 forms the toner image corresponding to image data of each color on the photosensitive drum 310. The image forming apparatus further includes an intermediate transfer belt 400 to which the toner image formed on the photosensitive drum 310 is primarily transferred. The toner images of respective colors primarily transferred to the intermediate transfer belt 400 in a superimposed manner are secondarily transferred to a recording sheet, which is conveyed from a paper feeding portion 200, by a transfer roller 410, thus forming a color image on the recording sheet. The recording sheet to which the toner images secondarily transferred from the intermediate transfer belt 400 are conveyed to a fixing device 500 and nipped by a fixing roller 510, where the toner images are heated and pressed to be fixed to the recording sheet.

The four image forming engines 300 are arranged under the intermediate transfer belt 400 in parallel, and the light scanning apparatus 100 is arranged under the image forming engine 300. The light scanning apparatus 100 emits laser light (laser beam) modulated according to the image data to the photosensitive drum 310 provided in the image forming engine 300. The photosensitive drum 310 is exposed by the laser light. The light scanning apparatus 100 comprises two light scanning apparatus 100*a* and 100*b*. Each of the light scanning apparatus 100*a* and 100*b* emits scanning lights in two paths. The light scanning apparatus 100*a* on one side emits laser lights for exposing the photosensitive drums 310Y and 310M, and the light scanning apparatus 100*b* on the other side emits laser lights for exposing the photosensitive drums 310C and 310Bk. The light scanning apparatus 100*a* is supported by a plate-shaped stay (placement unit) 40A, and the light scanning apparatus 100*b* is supported by a plate-shaped stay (placement unit) 40B.

Light Scanning Apparatus Mounted on Image Forming Apparatus

Figure 2A:
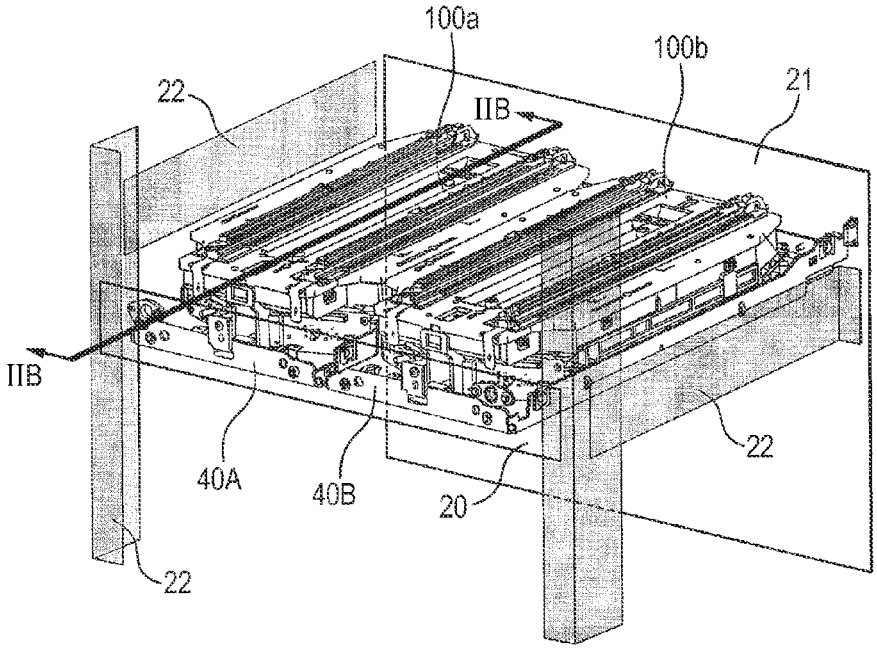
FIG. 2A (PRIOR ART)
FIG. 2A is a diagram illustrating a light scanning apparatus mounted on the image forming apparatus according to the first and second embodiments by a conventional mounting method.
Figure 2B:
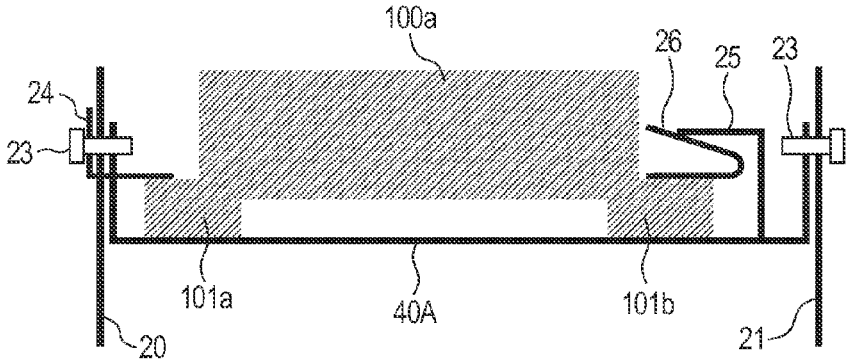
FIG. 2B (PRIOR ART)
FIG. 2B is a cross-sectional view of the image forming apparatus taken along a line IIB-IIB in FIG. 2A.

FIGS. 2A and 2B illustrate a configuration of the light scanning apparatus 100 mounted on the image forming apparatus by a conventional mounting method, to be compared with the first embodiment. FIG. 2A is a diagram illustrating the stays 40A and 40B on which the two light scanning apparatus 100*a* and 100*b* are respectively placed and which are mounted(fixed) on a main body of the image forming apparatus. Two side plates 20 and 21 are supported by a plurality of support members 22. The plurality of support members 22 are fixed in an integrated manner including the side plates 20 and 21, being formed as a frame of the image forming apparatus. FIG. 2B is a cross-sectional view of the image forming apparatus taken along a line IIB-IIB in FIG. 2A, illustrating a state in which the light scanning apparatus 100*a* is mounted on the stay 40A. In FIG. 2A, the side plate 20 has a smaller area than the side plate 21. This is because an opening through which the light scanning apparatuses are inserted into the image forming apparatus in order to mount the light scanning apparatus 100*a* and 100*b* on the image forming apparatus and an opening for opening and closing the paper feeding portion 200 to supply paper to the paper feeding portion 200 are provided on the side plate 20 side.

A housing of each of the light scanning apparatus 100*a* and 100*b* includes a plurality of protruding portions (leg portions, protruding portions of legs) 101*a* and 101*b* protruding in the horizontal direction and in the vertical direction from an outer wall of the housing, and the light scanning apparatus 100*a* and 100*b* are respectively placed on the stays 40A and 40B via the plurality of protruding portions 101*a* and 101*b*.

The stay 40A is mounted on the side plates 20 and 21 of the image forming apparatus by a plurality of screws 23, forming a shape of a bridge between the side plates 20 and 21. The stay 40A is positioned by the side plates 20 and 21. The protruding portion 101*a* of the light scanning apparatus 100*a* on the side of the side plate 20 (on the front side of the apparatus) is fixed on the stay 40A by being pressed toward the stay 40A by a pressing force from a leaf spring 24 mounted on the side plate 20. On the other hand, the protruding portion 101*b* of the light scanning apparatus 100*a* on the side of the side plate 21 (on the rear side of the apparatus) is fixed on the stay 40A by being pressed toward the stay 40A by a pressing force from a leaf spring 26 abutting a spring receiving portion 25 provided on the stay 40A. Therefore, the light scanning apparatus 100*a* is fixed on the stay 40A by the leaf springs 24 and 26, and the position of the light scanning apparatus 100*a* in the direction of gravity is determined by a position of the stay 40A mounted on the image forming apparatus. The leaf springs 24 and 26 are formed of, for example, stainless steel.

Optical Path of Light Scanning Apparatus

Figure 3A:
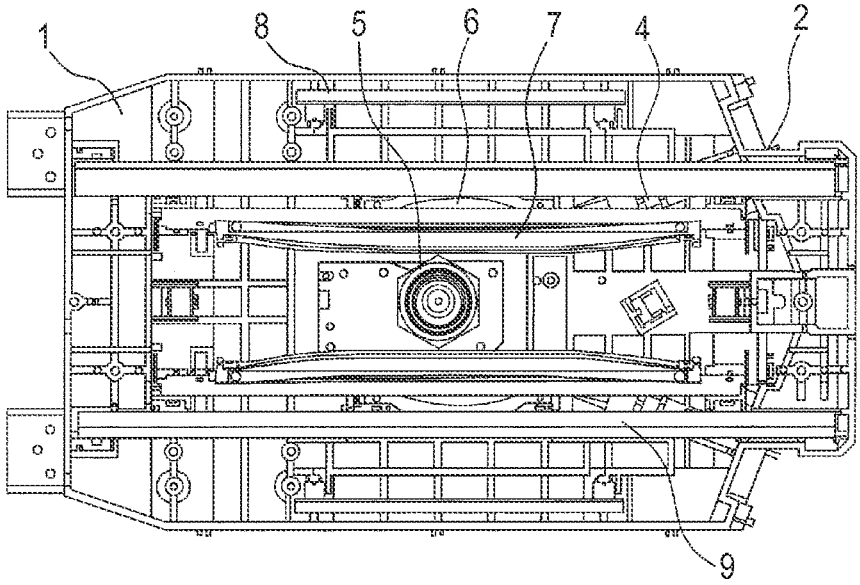
FIGS. 3A and 3B are diagrams illustrating a light scanning apparatus according to the first and second embodiments.
Figure 3B:
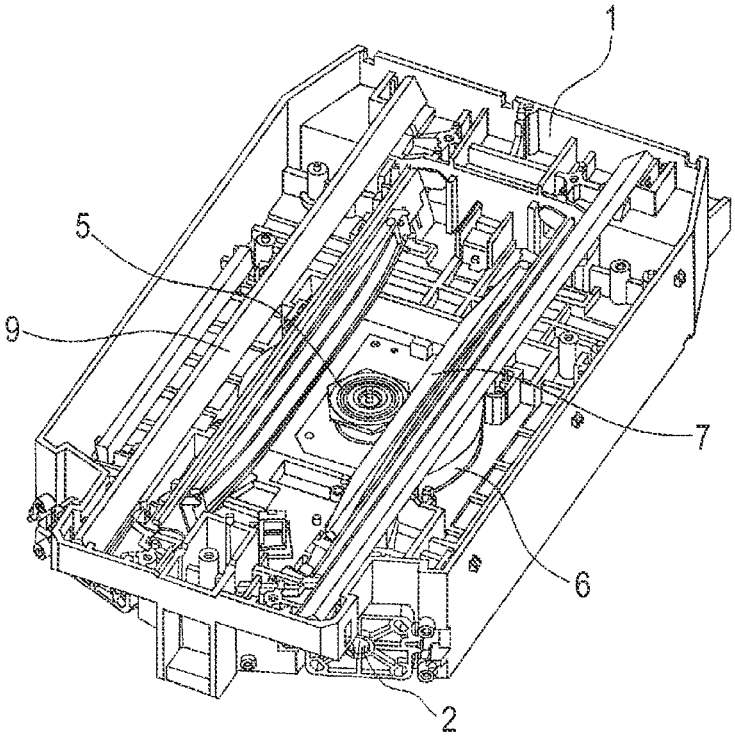
Figure 4A:
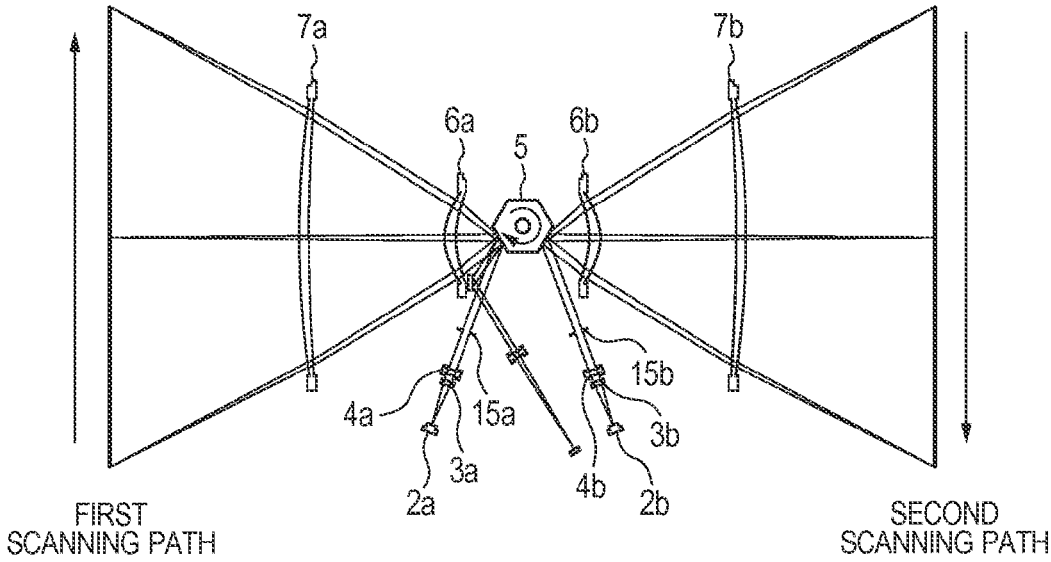
FIGS. 4A and 4B are cross-sectional views of the light scanning apparatus according to the first and second embodiments in a main scanning direction and a sub scanning direction, respectively.

FIG. 3A is a top plan view of the light scanning apparatus 100 according to the first embodiment. FIG. 3B is a perspective view of the light scanning apparatus 100. FIG. 4A is a main scanning cross-sectional view illustrating optical paths of the light scanning apparatus 100 expanded on a single plane by rotating the light scanning apparatus 100 illustrated in FIG. 3A by 90 degrees in a clockwise direction. A polygon mirror 5 serves as a deflecting unit which deflects laser light so that laser lights (laser beams) emitted from light sources 2*a* and 2*b* scan the respective photosensitive drums. A direction in which the laser light is scanned by a rotation of the polygon mirror 5 is called a main scanning direction, and a direction orthogonal to the main scanning direction and perpendicular to a rotation axis of the polygon mirror 5 is called a sub scanning direction. The main scanning cross section is a plane parallel to the scanning direction and perpendicular to the rotation axis of the polygon mirror 5.

As illustrated in FIG. 4A, two scanning paths are provided, including a first scanning path (optical path of laser light) and a second scanning path (optical path of laser light) symmetrically sandwiching the polygon mirror 5, and the light beams tracing the first scanning path and the second scanning path respectively scan the different photosensitive drums 310. In the first scanning path, the laser light emitted from the light source 2*a* is converted into a collimated light by a collimator lens 3*a*, and then converged only in the sub scanning direction by a cylindrical lens 4*a* right after. The laser light converged only in the sub scanning direction is shaped into a predetermined form by an aperture 15*a*, and then imaged in a line shape on a reflection surface of the polygon mirror 5. The laser light imaged on the polygon mirror 5 is deflected to scan the photosensitive drum 310 in a predetermined direction (direction substantially parallel to the rotation axis of the photosensitive drum 310) by the polygon mirror 5. The laser light deflected by the polygon mirror 5 moves at a constant velocity on the surface of the photosensitive drum 310 by passing through fθ lenses 6*a* and 7*a*. The configuration in the second scanning path is the same as the above-mentioned configuration in the first scanning path, and hence a description thereof is omitted. The fθ lenses 6*a* and 7*a* and reflection mirrors (first mirror and second mirror) 8*a* and 9*a* are optical members for guiding the laser light to the photosensitive drum 310Y, and accommodated in the housing of the light scanning apparatus 100*a* with the polygon mirror 5.

Figure 4B:
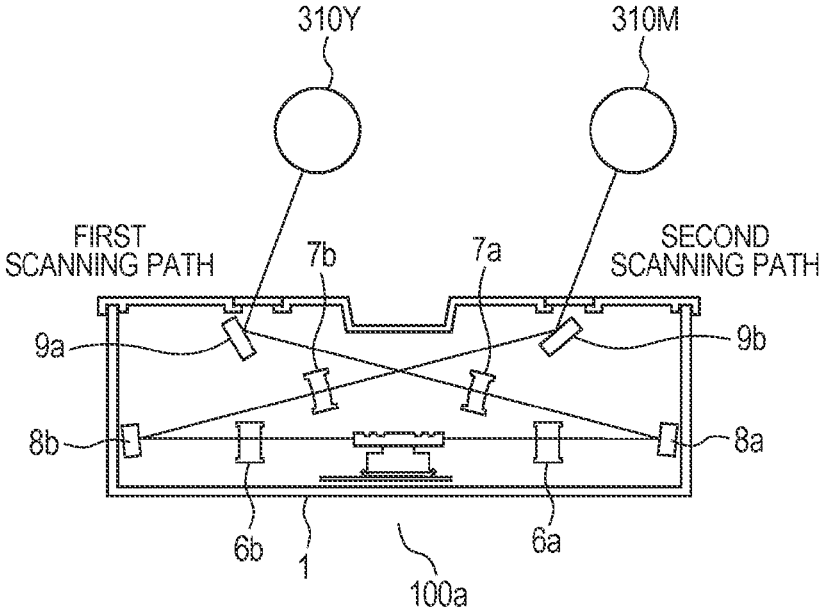

FIG. 4B is a sub scanning cross-sectional view of the light scanning apparatus 100*a* equipped with the optical system described with reference to FIG. 4A. The sub scanning cross section is a plane perpendicular to the scanning direction along which the laser light scans the photosensitive drum 310 and parallel to the rotation axis of the polygon mirror 5. Although the optical system is expanded on the plane in FIG. 4A, in practice, a three-dimensional laser light path is formed in the light scanning apparatus 100*a* by using the reflection mirrors as illustrated in FIG. 4B. Specifically, on the laser light path of the first scanning path, the light scanning apparatus 100*a* guides the laser light to the photosensitive drum 310Y by two reflections by arranging the first mirror 8*a* between the fθ lenses 6*a* and 7*a* and further arranging the second mirror 9*a* after the fθ lens 7*a*. The second scanning path has the same configuration as the first scanning path, and a description thereof is omitted. These optical components are all accommodated in the housing 1, constituting the light scanning apparatus 100*a*. The light scanning apparatus 100*b* has the same configuration as the light scanning apparatus 100*a*, and a description thereof is omitted.

Transmission of Vibration in Image Forming Apparatus

Figure 5:
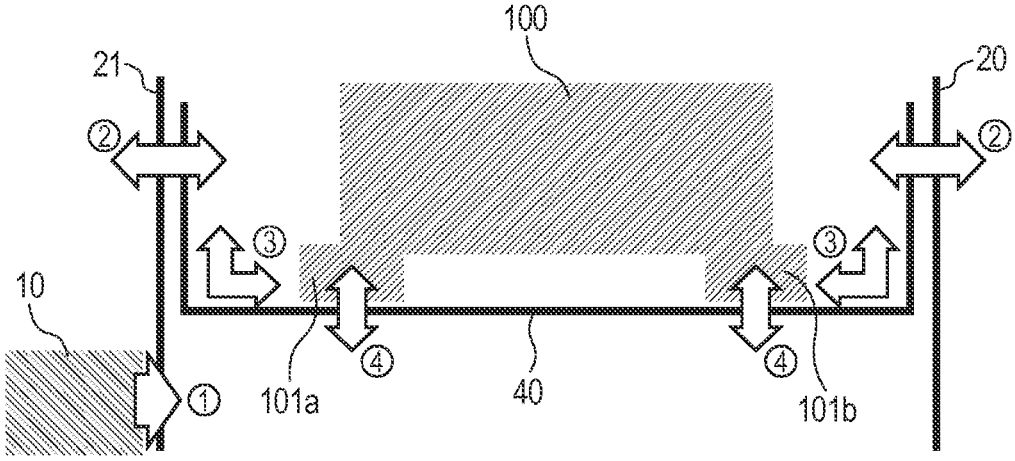
FIG. 5 is a diagram illustrating a vibration transmitting path (in the conventional way of mounting the light scanning apparatus) in the image forming apparatus according to the first and second embodiments.

FIG. 5 illustrates a vibration transmitted in the image forming apparatus illustrated in FIG. 2B, where the screws 23, the leaf spring 24, the spring receiving portion 25, and the leaf spring 26 are omitted. The light scanning apparatus 100 is mounted on the stay 40 that is fixed between the side plates 20 and 21 in order to support its weight. A vibration of a drive source 10 is generated by a motor and an engagement of gears to drive the transfer roller 410 and the fixing roller 510 in the image forming engine 300 and the fixing device 500 illustrated in FIG. 1. The vibration generated at the drive source 10 is then transmitted to the side plates 20 and 21 (encircled numeral "1" in FIG. 5), and transmitted from the side plates 20 and 21 to the stay 40 (encircled numeral "2" in FIG. 5). After that, the vibration transmitted to the stay 40 is transmitted through the stay 40 (encircled numeral "3" in FIG. 5), and then transmitted from the stay 40 to the light scanning apparatus 100 through the protruding portion 101*a* and the protruding portion 101*b* (encircled numeral "4" in FIG. 5).

Positioning of Light Scanning Apparatus in Direction of Gravity

Figure 6A:
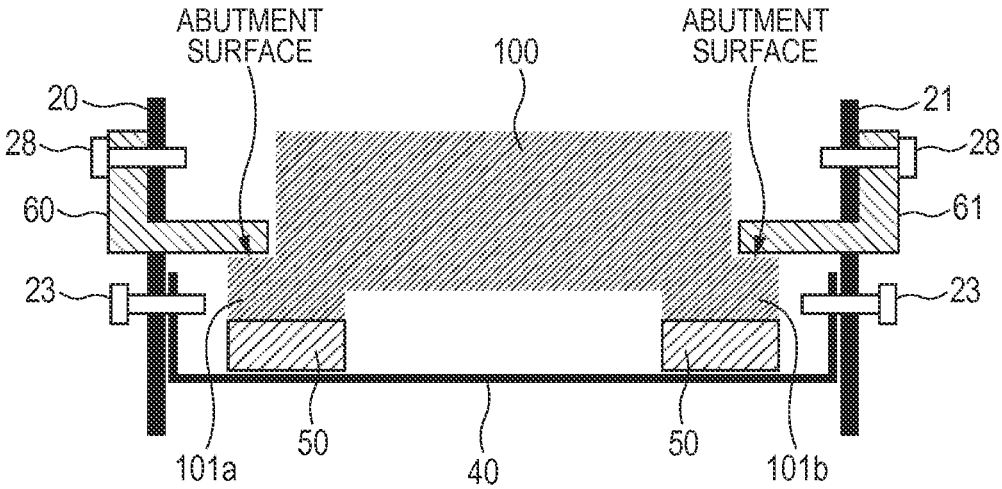
FIGS. 6A and 6B are diagrams illustrating a mounting portion of the light scanning apparatus according to the first embodiment.
Figure 6B:
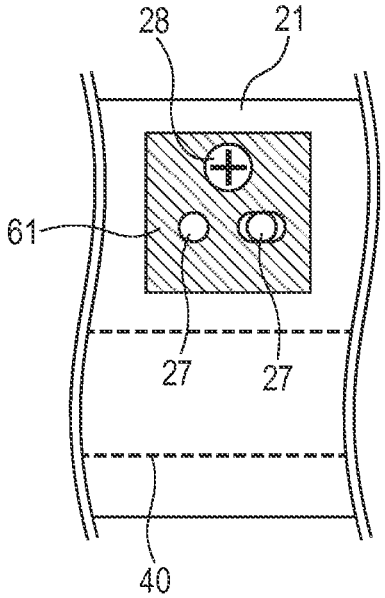

FIGS. 6A and 6B illustrate a configuration of a connecting portion between the light scanning apparatus 100 and the stay 40 in the image forming apparatus according to the first embodiment. As illustrated in FIG. 6A, the stay 40 is mounted between the side plates 20 and 21 with the screws 23 in such a manner that the stay 40 bridges between the side plates 20 and 21. Unlike the configuration illustrated in FIG. 2B, the light scanning apparatus 100 and the stay 40 are not in direct contact with each other, but elastic members 50 are disposed between the protruding portion 101*a* and the protruding portion 101*b* of the light scanning apparatus 100 and the stay 40, respectively, so that the elastic members 50 are placed on the stay 40 and the light scanning apparatus 100 is placed on the elastic members 50. However, with only this configuration, the light scanning apparatus 100 is not fixed in the direction of gravity, leaving the light scanning apparatus 100 with an unstable state of position in the direction of gravity.

Therefore, in a state in which a force is applied to the light scanning apparatus 100 in the direction of gravity so that the elastic members 50 are depressed, abutment members (pressing units or abutment units) 60 and 61 are fixed to the side plates 20 and 21 by screws 28, respectively. As illustrated in FIG. 6A, the abutment members 60 and 61 abut (press) the protruding portion 101*a* and the protruding portion 101*b* of the light scanning apparatus 100 from above in the direction of gravity, respectively. When the force applied to the light scanning apparatus 100 toward the stay 40 (placement unit side) (in the direction of gravity) is released, the light scanning apparatus 100 receives a force in a direction opposite to the direction of gravity by a repelling force of the elastic members 50, thus abutting the abutment members 60 and 61. Therefore, the elastic members 50 are constantly compressed to apply the repelling force for abutting the light scanning apparatus 100 against the abutment members 60 and 61. A compression amount of the elastic members 50 is set considering a temporal change and the like. For example, the elastic members 50 are compressed to half a height of an uncompressed state. A sponge is used as the elastic members 50, for example. The elastic members 50 and the stay 40 are adhered to each other by double-sided adhesive tape, for example.

The side plates 20 and 21 have holes through which the abutment members 60 and 61 extend, and positions of the abutment members 60 and 61 are determined by the side plates 20 and 21 as follows. FIG. 6B is a diagram obtained by rotating FIG. 6A by 90 degrees so that the side plate 21 comes to the front. As illustrated in FIG. 6B, the abutment member 61 has a circular hole and an elongated hole, and the side plate 21 has two positioning bosses 27. The elongated hole of the abutment member 61 is provided for preventing a rotation and as a countermeasure against a component tolerance. The positions of the abutment member 61 in the direction of gravity and the horizontal direction with respect to the side plate 21 are determined by the engagement of the positioning bosses 27 of the side plate 21 and the circular hole and the elongated hole of the abutment member 61. On the side plate 20, the positions of the abutment member 60 in the direction of gravity and the horizontal direction with respect to the side plate 20 are determined by the same configuration as that illustrated in FIG. 6B. Therefore, by abutting the light scanning apparatus 100 to the abutment members 60 and 61 that are positioned in the above-mentioned manner, the position of the light scanning apparatus 100 in the direction of gravity is determined.

Reduction in Vibration of Light Scanning Apparatus

The elastic member 50 has vibration reducing performance, and hence the vibration transmitted from the stay 40 to the light scanning apparatus 100, which is indicated by the encircled numeral "4" in FIG. 5, is reduced by adopting the configuration illustrated in FIGS. 6A and 6B. In addition, the side plates 20 and 21 have a high rigidity with respect to the direction of gravity, and hence it is less affected by a forced vibration of the stay 40. Therefore, because the abutment members 60 and 61 are mounted on the side plates 20 and 21 that are less affected by the forced vibration of the stay 40, the abutment members 60 and 61 are not affected by the forced vibration of the stay 40. The abutment members 60 and 61 may be mounted on other members in the main body of the image forming apparatus than the side plates 20 and 21 as long as the member does not receive a forced vibration due to the vibration of the stay 40. For example, the abutment members 60 and 61 may be mounted on side plates which support peripheral devices such as the photosensitive drum 310 and the developing device 320. The abutment members 60 and 61 are members for determining a position of the light scanning apparatus 100 in the direction of gravity.

Therefore, by using a material obtained by performing secondary processing on an aluminum die cast for the abutment members 60 and 61, the accuracy in the positions of the abutment members 60 and 61 in the direction of gravity is enhanced and the rigidity with respect to the direction of gravity is increased.

The abutment members 60 and 61 are members only for abutting the light scanning apparatus 100 from the direction opposite to the direction of gravity, and hence the abutment members 60 and 61 can be formed in a simple shape with a light weight. Therefore, simplifying the shape of the abutment members 60 and 61 and reducing their weights can increase the natural frequencies of the abutment members 60 and 61 and easily avoid a frequency of 100 Hz to 200 Hz (specific band) which may cause a noticeable uneven pitch. As a result, the abutment members 60 and 61 do not resonate at a frequency which causes a problem of the uneven pitch, and the noticeable uneven pitch never occurs.

Analysis of Vibration Reduction

Figure 7:
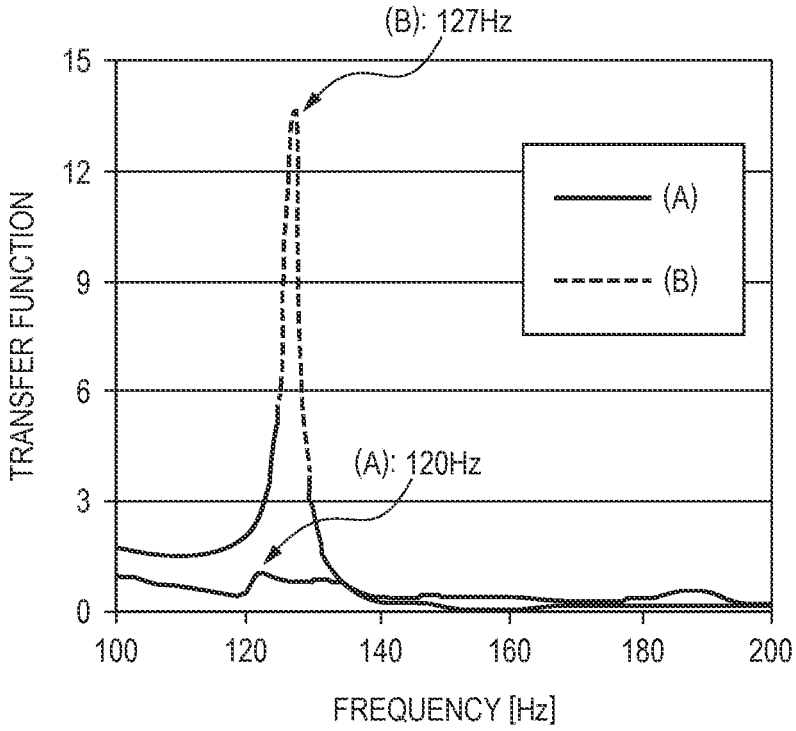
FIG. 7 is a graph showing a result of a vibration test of the light scanning apparatus according to the first embodiment.

FIG. 7 is a graph showing a transfer function of a vibration transmitted from a vibration exciter to the light scanning apparatus 100. In the image forming apparatus according to the first embodiment, the frequency of the vibration that causes a noticeable uneven pitch is 100 Hz to 200 Hz. Therefore, FIG. 7 shows a result of measuring the transfer function when the vibration of 100 Hz to 200 Hz is continuously applied (sweep vibration) from the vibration exciter for about 5 minutes. In the measurement of the transfer function shown in FIG. 7, the light scanning apparatus 100 and the stay 40 having the configuration illustrated in FIGS. 6A and 6B are fixed to a jigs, and the vibration is applied from the vibration exciter to the jig, to measure the vibration transmitted from the jig to the leg portions of the light scanning apparatus 100.

In FIG. 7, in order to confirm a vibration transmission reduction effect of the image forming apparatus according to the first embodiment, measurement results of two configurations are shown: a configuration of the image forming apparatus according to the first embodiment (solid line A); and a configuration of an image forming apparatus in which the elastic members 50 are not provided between the light scanning apparatus 100 and the stay 40 (dashed line B). The larger value of the transfer function on the vertical axis indicates the larger vibration transmitted to the light scanning apparatus 100. It is confirmed that there exists a large peak at 127 Hz in a curve (B) of the configuration of the image forming apparatus in which the elastic members 50 are not provided between the light scanning apparatus 100 and the stay 40 in FIG. 7. On the other hand, in a curve (A) of the configuration of the image forming apparatus according to the first embodiment in FIG. 7, it is confirmed that there exists a small peak at 120 Hz. The frequencies where these peaks exist are the natural frequencies of the stays 40 in the configurations of the respective image forming apparatus. A boundary condition of the stay 40 is changed depending on the existence of the elastic members 50 and the rigidity of the stay 40 is changed accordingly, and hence the natural frequency of the stay 40 having the elastic members 50 is lowered by 7 Hz. Comparing the transfer functions at the natural frequencies in FIG. 7, it is confirmed that the value of the transfer function of the configuration of the image forming apparatus according to the first embodiment in the curve (A) is decreased by 90% or more compared to the value of the transfer function of the configuration of the image forming apparatus in which the elastic members 50 are not provided between the light scanning apparatus 100 and the stay 40 in the curve (B). Further, in the configuration according to the first embodiment, it is confirmed that there exists no high peak in other frequencies such as the peak at 127 Hz. Therefore, by using the configuration according to the first embodiment, it is confirmed that the elastic members 50 reduce the transmission of the vibration from the stay 40 to the light scanning apparatus 100 in an effective manner, and the vibrations of the abutment members 60 and 61 do not affect the vibration of the light scanning apparatus 100.

According to the first embodiment described above, the vibration transmitted from the placement unit to the light scanning apparatus can be reduced and the light scanning apparatus can be positioned on the placement unit.

Second Embodiment

Configuration of Light Scanning Apparatus Mounting Portion

Figure 8:
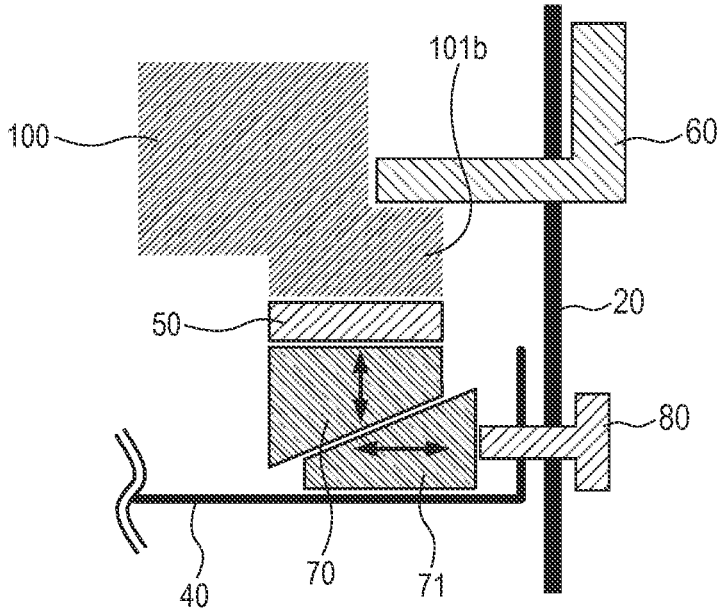
FIG. 8 is a diagram illustrating a mounting portion of the light scanning apparatus according to the second embodiment.

An image forming apparatus according to a second embodiment of the present invention has basically the same configuration as the configuration described in the first embodiment, except that a difference exists in the connecting portion of the stay 40 and the light scanning apparatus 100. FIGS. 1 to 5 described in the first embodiment are incorporated in the second embodiment. FIG. 8 is a diagram illustrating the connecting portion of the stay 40 and the light scanning apparatus 100 according to the second embodiment, including, unlike the image forming apparatus according to the first embodiment, a mechanism configured to adjust the compression amounts of the elastic members 50.

Adjustment of Compression Amount of Elastic Member

In order to adjust the compression amount of the elastic member 50, cams 70 and 71 (adjustment unit) are provided between the elastic member 50 and the stay 40. The cam 70 is adhered to the elastic member 50 by double-sided adhesive tape, and the cams 70 and 71 are formed of a material having high slidability, such as polyacetal (POM).

An adjustment screw 80 (movement amount changing unit) is provided extending through the side plate 20 and the stay 40. The cam 71 moves in the horizontal direction by a tightening amount of the adjustment screw 80. In association with the horizontal movement of the cam 71, the cam 70 moves in the direction of gravity. For example, in FIG. 8, the cam 71 moves to the left by tightening the adjustment screw 80. With the movement of the cam 71 to the left, the cam 70 moves in an upward direction. As the abutment member 60 is fixed, and hence the movement of the cam 70 in the upward direction further compresses the elastic member 50. On the other hand, the cam 71 moves to the right by loosening the adjustment screw 80. With the movement of the cam 71 to the right, the cam 70 moves in a downward direction. The abutment member 60 is fixed, and hence the movement of the cam 70 in the downward direction reduces the compressing force applied to the elastic member 50. Therefore, the tightening amount of the adjustment screw 80 adjusts the compression amount of the elastic member 50 in the direction of gravity, enabling a compression of the elastic member 50 with a desired compression amount.

In the first embodiment, there may be a possibility that the compression amount of the elastic member 50 cannot always be maintained to a desired value due to the component tolerances of the abutment members 60, 61, and the elastic members 50, and the temporal change of the elastic members 50. This may lead to a fluctuation in the vibration reducing performance of the elastic member 50 which reduces the vibration transmission. For example, if the compression amount is extremely large with respect to a thickness of the elastic member 50, the elastic member 50 is strongly compressed to be similar to a rigid body, which cannot fully make use of the vibration reducing effect. Therefore, providing the mechanism configured to adjust the compression amount of the elastic member 50 as illustrated in FIG. 8 enables the desired vibration reducing performance to be maintained in the elastic member 50. Although an example is illustrated in FIG. 8 as an embodiment in which the mechanism configured to adjust the compression amount of the elastic member 50 is provided only in one of the mounting portions of the light scanning apparatus 100, the present invention is not limited to this embodiment. That is, the mechanism configured to adjust the compression amount of the elastic member 50 may be provided in at least one of the mounting portions of the light scanning apparatus 100. For example, the mechanism configured to adjust the compression amount of the elastic member 50 may be provided in each of all of the mounting portions of the light scanning apparatus 100. By providing the mechanism configured to adjust the compression amount of the elastic member 50 in all of the mounting portions of the light scanning apparatus 100 and adjusting the compression amount of each elastic member 50, the vibration transmission reducing effect can be obtained in an even more effective manner. Although the configuration according to the second embodiment is the one in which the cams 70 and 71 are sandwiched between the stay 40 and the elastic member 50 as illustrated in FIG. 8, the present invention is not limited to the configuration illustrated in FIG. 8, but, for example, the cams 70 and 71 may be arranged between the elastic member 50 and the light scanning apparatus 100. In addition, although the configuration of using the cams 70 and 71 configured to convert a movement in the horizontal direction into a movement in the direction of gravity as the method of adjusting the compression amount of the elastic member 50 is described in the second embodiment, the present invention is not limited to the method according to the second embodiment, as long as the configuration can adjust the compression amount of the elastic member 50.

According to the second embodiment described above, the vibration transmitted from the placement unit to the light scanning apparatus can be reduced and the light scanning apparatus can be positioned on the placement unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-161653, filed Jul. 25, 2011, which is hereby incorporated by reference herein in its entirety.

What is claimed is:

1. An image forming apparatus, comprising:

a photosensitive member;

an exposure unit configured to emit a light beam based on image data to form an electrostatic latent image on the photosensitive member;

a placement unit configured to support the exposure unit, wherein the placement unit is fixed to a body of the image forming apparatus;

an elastic member placed on the placement unit, the exposure unit being placed on the elastic member so that the elastic member is disposed between the exposure unit and the placement unit;

a positioning member fixed to the body of the image forming apparatus and configured to be in contact with the exposure unit so that the elastic member is pressed by the exposure unit toward the placement unit, wherein a position of the exposure unit in a direction of gravity is regulated by the positioning member; and an adjustment unit configured to adjust a compression amount of the elastic member in the direction of gravity, wherein the adjustment unit includes:

a cam configured to be brought into contact with the elastic member and to convert a movement in a horizontal direction into a movement in the direction of gravity; and a movement amount changing unit mounted on the placement unit so as to be brought into contact with the cam and configured to change the movement of the cam in the horizontal direction.

2. The image forming apparatus according to claim 1, wherein the placement unit comprises a plate-shaped member and is fixed to the body of the image forming apparatus by a screw.

3. The image forming apparatus according to claim 1, wherein the exposure unit comprises a housing which has a protruding portion which protrudes from an outer wall of the housing in a horizontal direction and in a vertical direction.

4. The image forming apparatus according to claim 3, wherein the protruding portion of the exposure unit presses the elastic member toward the placement unit.

5. The image forming apparatus according to claim 3, wherein the elastic member is disposed between the protruding portion and the placement unit.

6. The image forming apparatus according to claim 1, wherein the body of the image forming apparatus includes a first side plate and a second side plate, the placement unit connects the first side plate and the second side plate, and the positioning member is fixed to the first side plate.

7. The image forming apparatus according to claim 6, wherein the image forming apparatus further includes a second elastic member placed on the placement unit, the exposure unit being placed on the second elastic member so that the second elastic member is disposed between the exposure unit and the placement unit, and wherein the image forming apparatus further comprises a second positioning member fixed to the second side plate and configured to be in contact with the exposure unit so that the second elastic member is pressed by the exposure unit against the placement unit.

8. The image forming apparatus according to claim 1, wherein the positioning member is separate from the placement unit.

9. The image forming apparatus according to claim 1, wherein a position in which the placement unit is fixed to the body is different from a position in which the positioning member is fixed to the body.

10. The image forming apparatus according to claim 1, wherein the positioning member is spaced from the placement unit.

11. An image forming apparatus, comprising:

a photosensitive member;

an exposure unit configured to emit a light beam based on image data to form an electrostatic latent image on the photosensitive member;

a placement unit configured to support the exposure unit, wherein the placement unit is fixed to a body of the image forming apparatus;

an elastic member placed on the placement unit, the exposure unit being placed on the elastic member so that the elastic member is disposed between the exposure unit and the placement unit; and a positioning member fixed to the body of the image forming apparatus and configured to be in contact with the exposure unit so that the elastic member is pressed by the exposure unit toward the placement unit, wherein a position of the exposure unit in a direction of gravity is regulated by the positioning member, wherein the body of the image forming apparatus includes a first side plate and a second side plate, the placement unit connects the first side plate and the second side plate, and the positioning member is fixed to the first side plate, and wherein the placement unit is fixed to the first side plate with a first screw, the positioning member is fixed to the first side plate by use of a second screw different from the first screw, and the second screw is located on the first side plate above the first screw in the direction of gravity.

12. An image forming apparatus, comprising:

an image bearing member;

a latent image forming unit configured to emit a light beam based on image data and to form an electrostatic latent image on the image bearing member by the light beam;

a placement unit fixed in a main body of the image forming apparatus, on which the latent image forming unit is placed;

an elastic member disposed between the latent image forming unit and the placement unit;

a pressing unit provided in the main body of the image forming apparatus and configured to press the latent image forming unit toward the placement unit so that the elastic member is pressed by the latent image forming unit and the placement unit; and an adjustment unit configured to adjust a compression amount of the elastic member in a direction of gravity, wherein the adjustment unit includes a cam configured to be brought into contact with the elastic member and to convert a movement in a horizontal direction into a movement in the direction of gravity, and a movement amount changing unit mounted on the placement unit so as to be brought into contact with the cam and configured to change the movement of the cam in the horizontal direction.

* * * * *